US005872092A

United States Patent [19]

Kong-Chan et al.

[11] Patent Number: 5,872,092

[45] Date of Patent: Feb. 16, 1999

[54] NONAQUEOUS BLEACH-CONTAINING LIQUID DETERGENT COMPOSITIONS

[75] Inventors: Josephine L. Kong-Chan, Cincinnati, Ohio; Kathleen B. Hunter, Villa Hills, Ky.

[73] Assignee: The Procter & Gamble Company, Cincinnati, Ohio

[21] Appl. No.: 878,458

[22] Filed: Jun. 18, 1997

Related U.S. Application Data

[63] Continuation of Ser. No. 313,522, Sep. 26, 1994, abandoned.

[51] Int. Cl.[6] ..... C11D 1/04; C11D 1/72; C11D 3/39

[52] U.S. Cl. ..... 510/413; 510/407; 510/414; 510/371; 510/372; 510/374; 510/376; 510/378; 510/418

[58] Field of Search ..... 510/407, 411, 510/413, 414, 371, 372, 374, 376, 378, 418

[56] References Cited

U.S. PATENT DOCUMENTS

| | | | |
|---|---|---|---|
| 4,399,049 | 8/1983 | Gray et al. | 252/91 |
| 4,615,820 | 10/1986 | Hepworth et al. | 252/139 |
| 4,622,173 | 11/1986 | Broze et al. | 252/528 |
| 4,652,391 | 3/1987 | Balk | 252/99 |
| 4,753,750 | 6/1988 | Ouhadi et al. | 252/139 |
| 4,767,558 | 8/1988 | Ouhadi et al. | 252/99 |
| 4,772,413 | 9/1988 | Massaux et al. | 252/102 |
| 4,781,856 | 11/1988 | Ouhadi et al. | 252/174.19 |
| 4,786,431 | 11/1988 | Broze et al. | 252/99 |
| 4,806,260 | 2/1989 | Broze et al. | 252/8.8 |
| 4,873,012 | 10/1989 | Broze et al. | 252/99 |
| 4,889,652 | 12/1989 | Sullivan et al. | 252/99 |
| 4,892,673 | 1/1990 | Dixit et al. | 252/114 |
| 4,908,159 | 3/1990 | Davies et al. | 252/559 |
| 4,929,380 | 5/1990 | Schultz et al. | 252/121 |
| 4,988,462 | 1/1991 | Schepers et al. | 252/174.22 |
| 5,102,574 | 4/1992 | Russell et al. | 252/174.21 |
| 5,266,233 | 11/1993 | Houghton et al. | 252/174.21 |
| 5,314,636 | 5/1994 | Rek et al. | 252/139 |
| 5,362,413 | 11/1994 | Kaufmann et al. | 252/174 |
| 5,441,661 | 8/1995 | Beaujean et al. | 252/95 |
| 5,518,645 | 5/1996 | Beaujean et al. | 252/108 |

FOREIGN PATENT DOCUMENTS

| | | | |
|---|---|---|---|
| 0 030 096 A1 | 6/1981 | European Pat. Off. | C11D 17/00 |
| 0 120 659 A2 | 3/1984 | European Pat. Off. | C11D 3/43 |
| 0 225 654 A1 | 6/1987 | European Pat. Off. | C11D 17/22 |
| 0 508 034 A1 | 12/1991 | European Pat. Off. | C11D 3/37 |
| 0 513 824 A2 | 5/1992 | European Pat. Off. | C11D 11/00 |
| 0 510 762 A2 | 10/1992 | European Pat. Off. | C11D 17/00 |
| 0 540 089 A1 | 5/1993 | European Pat. Off. | C11D 17/00 |
| 0 540 090 A2 | 5/1993 | European Pat. Off. | C11D 17/00 |
| 0 565 017 A2 | 10/1993 | European Pat. Off. | C11D 3/39 |
| 4024531A | 2/1992 | Germany | C11D 1/83 |
| 6 2030-198 A | 7/1985 | Japan | C11D 7/60 |
| 2 158 838 | 11/1985 | United Kingdom | C11D 10/02 |
| 2 194 536 | 3/1988 | United Kingdom | C07C 43/10 |
| 2 195 125 | 3/1988 | United Kingdom | C11D 3/60 |
| 2 195 649 | 4/1988 | United Kingdom | C11D 1/14 |
| WO 92/02610 | 7/1991 | WIPO | C11D 17/00 |
| WO 92/06166 | 4/1992 | WIPO | C11D 3/39 |
| WO 92/09678 | 6/1992 | WIPO | C11D 17/00 |
| WO 93/23521 | 11/1993 | WIPO | C11D 17/00 |
| WO 96/10072 | 4/1996 | WIPO | C11D 17/00 |

OTHER PUBLICATIONS

USSN 08/741,644 Hunter et al Filed Oct. 25, 1996, a continuation of 08/313,517, filed Sep. 26, 1994.

*Primary Examiner*—Paul Lieberman
*Assistant Examiner*—Gregory R. Delcotto
*Attorney, Agent, or Firm*—Steven R. Chuey; Kim W. Zerby; Jacobus C. Rasser

[57] ABSTRACT

Disclosed are nonaqueous, bleach-containing liquid laundry detergent compositions which are in the form of a suspension of particulate material, including peroxygen bleaching agent and an alkyl sulfate anionic surfactant, dispersed in a liquid phase containing an alcohol ethoxylate nonionic surfactant and a nonaqueous, low-polarity organic solvent. Such compositions provide especially desirable cleaning and bleaching of fabrics laundered therewith and also exhibit especially desirable chemical and phase stability.

20 Claims, No Drawings

NONAQUEOUS BLEACH-CONTAINING LIQUID DETERGENT COMPOSITIONS

CROSS-REFERENCE TO RELATED APPLICATION

This application is a file wrapper continuation of our application Ser. No. 08/313,522, now abandoned, filed Sep. 26, 1994.

FIELD OF THE INVENTION

This invention relates to heavy duty liquid (HDL) laundry detergent products which are nonaqueous in nature and which contain a bleaching system based on peroxygen bleaching agents.

Background of the Invention

Liquid detergent products are often considered to be more convenient to use than are dry powdered or particulate detergent products. Liquid detergents have therefore found substantial favor with consumers. Such liquid detergent products are readily measurable, speedily dissolved in the wash water, capable of being easily applied in concentrated solutions or dispersions to soiled areas on garments to be laundered and are non-dusting. They also usually occupy less storage space than granular products. Additionally, liquid detergents may have incorporated in their formulations materials which could not withstand drying operations without deterioration, which operations are often employed in the manufacture of particulate or granular detergent products.

Although liquid detergents have a number of advantages over granular detergent products, they also inherently possess several disadvantages. In particular, detergent composition components which may be compatible with each other in granular products may tend to interact or react with each other in a liquid, and especially in an aqueous liquid, environment. Thus such components as enzymes, surfactants, perfumes, brighteners, solvents and especially bleaches and bleach activators can be especially difficult to incorporate into liquid detergent products which have an acceptable degree of chemical stability.

One approach for enhancing the chemical compatibility of detergent composition components in liquid detergent products has been to formulate nonaqueous (or anhydrous) liquid detergent compositions. In such nonaqueous products, at least some of the normally solid detergent composition components tend to remain insoluble in the liquid product and hence are less reactive with each other than if they had been dissolved in the liquid matrix. Nonaqueous liquid detergent compositions, including those which contain reactive materials such as peroxygen bleaching agents, have been disclosed for example, in Hepworth et al., U.S. Pat. No. 4,615,820, Issued Oct. 17, 1986; Schultz et al., U.S. Pat. No. 4,929,380, Issued May 29, 1990; Schultz et al., U.S. Pat. No. 5,008,031, Issued Apr. 16, 1991; Elder et al., EP-A-030,096, Published Jun. 10, 1981; Hall et al., WO 92/09678, Published Jun. 11, 1992 and Sanderson et al., EP-A-565,017, Published Oct. 13, 1993.

Even though chemical compatibility of components may be enhanced in nonaqueous liquid detergent compositions, physical stability of such compositions may become a problem. This is because there is a tendency for such products to phase separate as dispersed insoluble solid particulate material drops from suspension and settles at the bottom of the container holding the liquid detergent product.

As one consequence of this type of problem, there can also be difficulties associated with incorporating enough of the right types and amounts of surfactant materials into nonaqueous liquid detergent products. Surfactant materials must, of course, be selected such that they are suitable for imparting acceptable fabric cleaning performance to such compositions but utilization of such materials must not lead to an unacceptable degree of composition phase separation.

Given the foregoing, there is clearly a continuing need to identify and provide liquid, bleach-containing detergent compositions in the form of nonaqueous liquid products that have a high degree of chemical, e.g., bleach and enzyme, stability along with commercially acceptable phase stability and detergent composition cleaning/bleaching performance. Accordingly, it is an object of the present invention to provide nonaqueous, bleach-containing liquid detergent products which have such especially desirable chemical and physical stability characteristics as well as outstanding fabric laundering/bleaching performance characteristics.

SUMMARY OF THE INVENTION

The present invention provides nonaqueous liquid heavy-duty detergent compositions comprising a stable suspension of solid, substantially insoluble particulate material dispersed within a nonaqueous liquid phase. The particulate material utilized comprises an inorganic peroxygen bleaching agent and a particular type of anionic surfactant. The liquid phase comprises a particular type of nonionic surfactant and a nonaqueous, low-polarity organic solvent.

Such compositions comprise A) from about 1% to 60% by weight of the composition of a nonionic surfactant component which comprises alcohol ethoxylates of the formula $R^1(OC_2H_4)_nOH$ wherein $R^1$ is a $C_6$–$C_{16}$ alkyl group and n is from about 1 to 80; B) from about 10% to 40% by weight of the composition of an anionic surfactant component which is substantially free of alkyl benzene sulfonate surfactant materials and which comprises sulfated anionic surfactants produced by the sulfation of higher $C_8$–$C_{20}$ alcohols; C) from about 2% to 30% by weight of the composition of particles of the peroxygen bleaching agent, which particles range in size from about 0.2 to 1,000 microns; and D) from about 1% to 60% by weight of the composition of the nonaqueous, low-polarity organic solvent component. Such compositions may also contain a wide variety of optional surfactants, builders and alkalinity sources, enzymes, bleach activators, chelating agents, viscosity control/thickening agents, brighteners and perfumes.

DETAILED DESCRIPTION OF THE INVENTION

The nonaqueous liquid detergent compositions of this invention comprise a nonionic surfactant—and low-polarity solvent-containing liquid phase having dispersed therein as a solid phase certain types of particulate materials. The essential and optional components of the liquid and solid phases of the detergent compositions herein, as well as composition form, preparation and use, are described in greater detail as follows: All concentrations and ratios are on a weight basis unless otherwise specified.

Liquid Phase

The liquid phase of the detergent compositions herein essentially contains certain types of nonionic surfactants and certain types of nonaqueous, low-polarity solvents.

(A) Nonionic Surfactant

The liquid phase of the detergent compositions of this invention essentially comprises an ethoxylated fatty alcohol nonionic surfactant. Such a material corresponds to the general formula:

$$R^1(OC_2H_4)_nOH$$

wherein $R^1$ is a $C_6$–$C_{16}$ alkyl group and n ranges from about 1 to 80. Preferably the $R^1$ alkyl group, which may be primary or secondary, contains from about 9 to 15 carbon atoms, more preferably from about 10 to 14 carbon atoms. Preferably the ethoxylated fatty alcohol will contain from about 2 to 12 ethylene oxide moieties per molecule, more preferably from about 3 to 10 ethylene oxide moieties per molecule.

The ethoxylated fatty alcohol nonionic surfactant will frequently have a hydrophilic-lipophilic balance (HLB) which ranges from about 3 to 17. More preferably, the HLB of this material will range from about 6 to 15, most preferably from about 10 to 15.

Examples of fatty alcohol ethoxylates useful as the essential liquid nonionic surfactant in the compositions herein will include those which are made from alcohols of 12 to 15 carbon atoms and which contain about 7 moles of ethylene oxide. Such materials have been commercially marketed under the tradenames Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylate nonionics useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

The alcohol ethoxylate nonionic which is essentially utilized as part of the liquid phase of the nonaqueous compositions herein will generally be present to the extent of from about 1% to 60% by weight of the composition. More preferably, the alcohol ethoxylate nonionic will comprise from about 5% to 35% by weight of the compositions herein. Most preferably, the essentially utilized alcohol ethoxylate nonionic will comprise from about 8% to 25% by weight of the detergent compositions herein.

(B) Nonaqueous, Low-Polarity Organic Solvent

A second essential component of the liquid phase of the detergent compositions herein comprises nonaqueous, low-polarity organic solvent(s). The term "solvent" is used herein to connote the non-surface active carrier or diluent portion of the liquid phase of the composition. While some of the essential and/or optional components of the compositions herein may actually dissolve in the "solvent"-containing liquid phase, other components will be present as particulate material dispersed within the "solvent"-containing liquid phase. Thus the term "solvent" is not meant to require that the solvent material be capable of actually dissolving all of the detergent composition components added thereto.

The nonaqueous organic materials which are employed as solvents herein are those which are liquids of low polarity. For purposes of this invention, "low-polarity" liquids are those which have little, if any, tendency to dissolve the peroxygen bleach, e.g., sodium perborate, and optional bleach activators, e.g., sodium nonanoyloxybenzene sulfonate (NOBS), which are present in the nonaqueous compositions herein. Thus relatively polar solvents such as ethanol and propanediol should not be utilized. Suitable types of low-polarity solvents useful in the nonaqueous liquid detergent compositions herein do include alkylene glycol mono lower alkyl ethers, lower molecular weight polyethylene glycols, lower molecular weight methyl esters and amides, and the like.

A preferred type of nonaqueous, low-polarity solvent for use herein comprises the mono-, di-, tri-, or tetra- $C_2$–$C_3$ alkylene glycol mono $C_2$–$C_6$ alkyl ethers. Specific examples of such compounds include diethylene glycol monobutyl ether, tetraethylene glycol monobutyl ether, dipropolyene glycol monoethyl ether and dipropylene glycol monobutyl ether. Diethylene glycol monobutyl ether and dipropylene glycol monobutyl ether are especially preferred. Compounds of this type have been commercially marketed under the tradenames Dowanol, Carbitol and Cellosolve.

Another preferred type of nonaqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, nonaqueous solvent comprises lower molecular weight methyl esters. Such materials are those of the general formula: $R^1$-C(O)—$OCH_3$ wherein $R^1$ ranges from 1 to about 18. Examples of suitable lower molecular weight methyl esters include methyl acetate, methyl propionate, methyl octanoate and methyl dodecanoate.

The nonaqueous, low-polarity organic solvent(s) employed should, of course, be compatible and non-reactive with other composition components, e.g., bleach and/or activators, used in the liquid detergent compositions herein. Such a solvent component will generally be utilized in an amount of from about 1% to 60% by weight of the composition. More preferably, the nonaqueous, low-polarity organic solvent will comprise from about 15% to 45% by weight of the composition, most preferably from about 20% to 45% by weight of the composition.

Solid Phase

The nonaqueous detergent compositions herein also essentially comprise a solid phase of particulate material which is dispersed and suspended within the liquid phase. The two essential components of the solid phase are A) a peroxygen compound bleaching agent, and B) a certain type of anionic surfactant. Each of these essential components is described in greater detail as follows:

(A) Peroxygen Bleaching Agent With Optional Bleach Activators

One essential component of the solid phase of the detergent compositions herein comprises particles of a peroxygen bleaching agent. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Burns et al.

Inorganic peroxygen bleaching agents may also be used in particulate form in the detergent compositions herein. Inorganic bleaching agents are in fact preferred. Such inorganic peroxygen compounds include alkali metal perborate and percarbonate materials. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical and preferred. Mixtures thereof can also be used. See also the hereinbefore referenced U.S. Pat. No. 4,634,551 for other typical bleaches and activators useful herein.

Other useful amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenol sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate and mixtures thereof as described in the hereinbefore referenced U.S. Pat. No. 4,634,551.

Another class of useful bleach activators comprises the benzoxazin-type activators disclosed by Hodge et al. in U.S. Pat. No. 4,966,723, Issued Oct. 30, 1990, incorporated herein by reference. A highly preferred activator of the benzoxazin-type is:

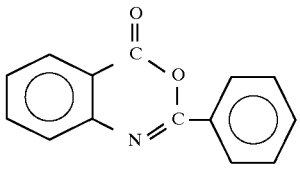

Still another class of useful bleach activators includes the acyl lactam activators, especially acyl caprolactams and acyl valerolactams of the formulae:

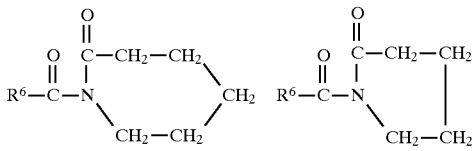

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, 3,5,5-trimethylhexanoyl valerolactam and mixtures thereof See also U.S. Pat. No. 4,545,784, Issued to Sanderson, Oct. 8, 1985, incorporated herein by reference, which discloses acyl caprolactams, including benzoyl caprolactam, adsorbed into sodium perborate.

Still another class of useful bleach activators are those which are liquid in form at room temperature and can be added as liquids to the nonaqueous liquid phase of the detergent compositions herein. One such liquid bleach activator is acetyl triethyl citrate (ATC). Other examples include glycerol triacetate and nonanoyl valerolactam.

The peroxygen bleaching agent particles, and activator particles for those activators which are solids, should have an average particle size which ranges from about 0.2 to 1,000 microns, more preferably from about 1 to 800 microns. Preferably, no more than about 10% by weight of the bleaching agent and/or activator particles will be smaller than about 1 micron and no more than about 10% by weight of such particles will be larger than about 500 microns. Both peroxygen bleaching agent, and bleach activator if a solid activator is utilized, should be in the form of particles which are substantially insoluble in the nonaqueous liquid phase of the present compositions.

Peroxygen bleaching agent will generally comprise from about 2% to 30% by weight of the composition. More preferably, peroxygen bleaching agent will comprise from about 2% to 20% by weight of the composition. Most preferably, peroxygen bleaching agent will be present to the extent of from about 3% to 15% by weight of the composition. If utilized, bleach activators can comprise from about 2% to 10% by weight of the composition. Frequently, activators are employed such that the molar ratio of bleaching agent to activator ranges from about 1:1 to 10:1, more preferably from about 1.5:1 to 5:1.

(B) Essential Anionic Surfactant

Another essential component of the solid phase of the detergent compositions herein comprises a primary or secondary alkyl sulfate anionic surfactant. Such surfactants are those produced by the sulfation of higher $C_8$–$C_{20}$ fatty alcohols.

Conventional primary alkyl sulfate surfactants have the general formula $$ROSO_3^-M^+$$

wherein R is typically a linear $C_8$–$C_{20}$ hydrocarbyl group, which may be straight chain or branched chain, and M is a water-solubilizing cation. Preferably R is a $C_{10}$–$C_{14}$ alkyl, and M is alkali metal. Most preferably R is about $C_{12}$ and M is sodium.

Conventional secondary alkyl sulfates may also be utilized as the essential anionic surfactant component of the solid phase of the compositions herein. Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)\ (CH_2)_mCH_3$$

wherein m and n are integers of 2 or greater and the sum of m+n is typically about 9 to 15, and M is a water-solubilizing cation.

Especially preferred types of secondary alkyl sulfates are the (2,3) alkyl sulfate surfactants which can be represented by structures of formulas A and B (A) $CH_3(CH_2)_x(CHOSO_3^-M^+)\ CH_3$ and (B) $CH_3(CH_2)_y(CHOSO_3^-M^+)\ CH_2CH_3$ for the 2-sulfate and 3-sulfate, respectively. In formulas A and B, x and (y+1) are, respectively, integers of at least about 6, and can range from about 7 to about 20, preferably about 10 to about 16. M is a cation, such as an alkali metal, alkaline earth metal, or the like. Sodium is typical for use as M to prepare the water-soluble (2,3) alkyl sulfates, but potassium, and the like, can also be used.

The alkyl sulfate surfactants essentially utilized herein do not generally dissolve in the liquid phase and will hence be dispersed throughout the liquid phase as discrete particles. Such particles will typically range in size from about 0.2 to 1,000 microns, more preferably from about 1 to 800 microns.

The requisite alkyl sulfate anionic surfactant should be used in relatively high concentrations in order to provide suitable soil/stain removal performance and in order to provide suspension phase stability for the nonaqueous detergent compositions herein. The alkyl sulfate surfactant will generally range from about 10% to 40% by weight of the compositions herein. More preferably, alkyl sulfate will be utilized to the extent of from about 16% to 30% by weight of the composition. Frequently, alkyl sulfate surfactant will be employed in amounts sufficient to provide a liquid phase to alkyl sulfate anionic weight ratio of from about 1:1 to 5:1, more preferably from about 1.5:1 to 3.5:1.

Optional Composition Components

In addition to the essential composition liquid and solid phase components as hereinbefore described, the detergent compositions herein can, and preferably will, contain various optional components. Such optional components may be in either liquid or solid form. The solid form optional components may either dissolve in the liquid phase or may be dispersed within the liquid phase in fine particulate form, as part of the solid phase of the composition. Some of the materials which may optionally be utilized in the compositions herein are described in greater detail as follows:

(A) Optional Surfactants

Besides the essentially utilized alcohol ethoxylates and alkyl sulfate surfactants, the detergent compositions herein may also contain other types of surfactant materials, provided such additional surfactants are compatible with other composition components and do not substantially adversely affect composition stability or performance. Optional surfactants can be of the anionic, nonionic, cationic, and/or amphoteric type. If employed, optional surfactants will generally comprise from about 1% to 20% by weight of the compositions herein, more preferably from about 5% to 10% by weight of the compositions herein.

One preferred type of optional nonionic surfactant comprises surfactants which are ethylene oxide (EO)—propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; *Synthetic Detergents 7th Ed.;* Longman Scientific and Technical (1987) at pp. 34–36 and pp. 189–191 and in U.S. Pat. Nos. 2,674,619 and 2,677,700. All of these publications are incorporated herein by reference. These Pluronic type nonionic surfactants are believed to function as effective suspending agents for the particulate material which is dispersed in the liquid phase of the detergent compositions herein.

One common type of anionic surfactant which should not be utilized in the compositions herein comprises the sulfonated anionics which are alkyl benzene sulfonates. Such non-bleach activating sulfonated anionic surfactants, like linear alkylbenzene sulfonate (LAS), tend not to provide acceptable phase properties for the nonaqueous liquid detergent compositions of this invention. Accordingly, such compositions should generally be substantially free of alkyl benzene sulfonate anionic surfactant materials.

(B) Optional Organic Detergent Builders

The detergent compositions herein may also optionally contain an organic detergent builder material which serves to counteract the effects of calcium, or other ion, water hardness encountered during laundering/bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples are organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark.

If utilized, optional organic builder materials will generally comprise from about 1% to 60%, more preferably from about 3% to 50%, most preferably from about 3% to 20%, by weight of the compositions herein.

(C) Optional Alkalinity Source

The detergent compositions herein may also optionally contain a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant in the nonaqueous liquid detergent compositions herein. The presence of an alkalinity source which is also a desiccant may provide benefits in terms of chemically stabilizing those composition components such as the peroxygen bleaching agent which are susceptible to deactivation by water.

If utilized, the alkalinity source will generally comprise from about 5% to 30% by weight of the compositions herein. More preferably, the alkalinity source can comprise from about 5% to 20% by weight of the composition. Such materials, while water-soluble, will generally be insoluble in the nonaqueous detergent compositions herein. Thus such materials will generally be dispersed in the nonaqueous liquid phase in the form of discrete particles.

(D) Optional Chelating Agents

The detergent compositions herein may also optionally contain a chelating agent which serves to chelate metal ions, e.g., iron and/or manganese, within the nonaqueous detergent compositions herein. Such chelating agents thus serve to form complexes with metal impurities in the composition which would otherwise tend to deactivate composition components such as the peroxygen bleaching agent. Useful chelating agents can include amino carboxylates, amino phosphonates, polyfunctionally-substituted aromatic chelating agents and mixtures thereof.

Amino carboxylates useful as optional chelating agents include ethylenediaminetetraacetates, N-hydroxyethylethylenediaminetriacetates, nitrilotriacetates, ethylenediamine tetrapropionates, triethylenetetra-aminehexacetates, diethylenetriaminepentaacetates, ethylenediaminedisuccinates and ethanoldiglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

(E) Optional Enzymes

The detergent compositions herein may also optionally contain one or more types of detergent enzymes. Such enzymes can include proteases, amylases, cellulases and lipases. Such materials are known in the art and are commercially available. They may be incorporated into the nonaqueous liquid detergent compositions herein in the form of suspensions, "marumes" or "prills".

Enzymes added to the compositions herein in the form of conventional enzyme prills are especially preferred for use herein. Such prills will generally range in size from about 100 to 1,000 microns, more preferably from about 200 to 800 microns and will be suspended throughout the nonaqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

If employed, enzymes will normally be incorporated into the nonaqueous liquid compositions herein at levels sufficient to provide up to about 10 mg by weight, more typically from about 0.01 mg to about 5 mg, of active enzyme per gram of the composition. Stated otherwise, the nonaqueous liquid detergent compositions herein will typically comprise from about 0.001% to 5%, preferably from about 0.01% to 1% by weight, of a commercial enzyme preparation. Protease enzymes, for example, are usually present in such commercial preparations at levels sufficient to provide from 0.005 to 0.1 Anson units (AU) of activity per gram of composition.

(F) Optional Thickening, Viscosity Control and/or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP).

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

If utilized, the optional thickening, viscosity control and/or dispersing agents should be present in the compositions herein to the extent of from about 0.1% to 4% by weight. More preferably, such materials can comprise from about 0.5% to 2% by weight of the detergents compositions herein.

(G) Optional Brighteners, Suds Suppressors and/or Perfumes

The detergent compositions herein may also optionally contain conventional brighteners, suds suppressors and/or perfume materials. Such brighteners, suds suppressors and perfumes must, of course, be compatible and non-reactive with the other composition components in a nonaqueous environment. If present, brighteners suds suppressors and/or perfumes will typically comprise from about 0.1% to 2% by weight of the compositions herein.

Composition Form

As indicated, the nonaqueous liquid detergent compositions herein are in the form of bleaching agent and other materials in particulate form as a solid phase suspended in and dispersed throughout a nonaqueous liquid phase. Generally, the nonaqueous liquid phase will comprise from about 30% to 70% by weight of the composition with the dispersed solid phase comprising from about 30% to 70% by weight of the composition. Generally, size of the solid, insoluble particulate material (other than enzyme prills) dispersed in the liquid phase will range from about 0.2 to 1,000 microns, more preferably from about 1 to 800 microns.

The bleach-containing liquid detergent compositions of this invention are substantially nonaqueous (or anhydrous) in character. While very small amounts of water may be incorporated into such compositions as an impurity in the essential or optional components, the amount of water should in no event exceed about 5% by weight of the compositions herein. More preferably, water content of the nonaqueous detergent compositions herein will comprise less than about 2% by weight.

The bleach-containing nonaqueous liquid detergent compositions herein will be relatively viscous and phase stable under conditions of commercial marketing and use of such compositions. Generally viscosity of the compositions herein will range from about 300 to 5,000 cps, more preferably from about 500 to 3,000 cps. For purposes of this invention, viscosity is measured with a Brookfield Viscometer using a RV #5 spindle at 50 rpm.

Composition Preparation and Use

The nonaqueous liquid detergent compositions herein can be prepared by combining the essential and optional components thereof in any convenient order and by mixing, e.g., agitating, the resulting component combination to form the phase stable compositions herein. In a preferred process for preparing such compositions, essential and certain preferred optional components will be combined in a particular order. Such a process is described in detail in the concurrently filed U.S. patent application of Kathleen B. Hunter and Josephine L. Kong-Chan, said application having U.S. Ser. No. 08/313,517.

In such a preferred preparation process, a liquid matrix is formed containing at least a major proportion, and preferably substantially all, of the liquid components, e.g., the essential alcohol ethoxylate nonionic surfactant and the nonaqueous, low-polarity organic solvent, with the liquid components being thoroughly admixed by imparting shear agitation to this liquid combination. For example, rapid stirring with a mechanical stirrer may usefully be employed.

While shear agitation is maintained, essentially all of the alkyl sulfate anionic surfactant, e.g., sodium lauryl sulfate, can be added in the form of particles ranging in size from about 0.2 to 1,000 microns. After addition of the alkyl sulfate particles, particles of substantially all of an alkalinity source, e.g., sodium carbonate, can be added while continuing to maintain this admixture of composition components under shear agitation. Other solid form optional ingredients can be added to the composition at this point. Agitation of the mixture is continued, and if necessary, can be increased at this point to form a uniform dispersion of insoluble solid phase particulates within the liquid phase.

After some or all of the optional solid materials have been added to this agitated mixture, the particles of the requisite peroxygen bleaching agent can be added to the composition, again while the mixture is maintained under shear agitation. By adding the peroxygen bleaching agent material last, or after all or most of the other components, and especially after the alkalinity source particles, have been added, desirable stability benefits for the peroxygen bleach can be realized. If enzyme prills are incorporated, they are preferably added to the nonaqueous liquid matrix last.

After addition of the bleaching agent particles, agitation of the mixture is continued for a period of time sufficient to form compositions having the requisite viscosity and phase stability characteristics. Frequently this will involve agitation for a period of from about 30 to 60 minutes.

As a variation of the composition preparation procedure hereinbefore described, one or more of the solid components may be added to the agitated mixture as a slurry of particles premixed with a minor portion of one or more of the liquid components. Thus a premix of a small fraction of the nonionic surfactant and/or nonaqueous, low-polarity solvent with particles of the alkyl sulfate surfactant and/or the particles of the alkalinity source and/or particles of a bleach activator may be separately formed and added as a slurry to the agitated mixture of composition components. Addition of such slurry premixes should precede addition of peroxygen bleaching agent particles which may themselves be part of a premix slurry formed in analogous fashion.

The compositions of this invention, prepared as hereinbefore described, can be used to form aqueous washing solutions for use in the laundering and bleaching of fabrics. Generally, an effective amount of such compositions is added to water, preferably in a conventional fabric laundering automatic washing machine, to form such aqueous laundering/bleaching solutions. The aqueous washing/bleaching solution so formed is then contacted, preferably under agitation, with the fabrics to be laundered and bleached therewith.

An effective amount of the liquid detergent compositions herein added to water to form aqueous laundering/bleaching solutions can comprise amounts sufficient to form from about 500 to 7,000 ppm of composition in aqueous solution. More preferably, from about 1,000 to 3,000 ppm of the detergent compositions herein will be provided in aqueous washing/bleaching solution.

EXAMPLES

The following examples illustrate the compositions of the present invention, but are not necessarily meant to limit or otherwise define the scope of the invention herein.

Example I

A composition of the present invention is prepared by mixing together the ingredients listed in Table I in the proportions shown.

TABLE I

| Component | Wt. % | Gm | Function | Form |
|---|---|---|---|---|
| Neodol 1-5* | 14.4 | 71.9 | Liquid Nonionic | Liquid |
| Dipropylene glycol monobutyl ether | 29.6 | 147.8 | Surfactant Low Polarity Organic | Liquid |
| Pluronic 10R5** | 9.6 | 47.9 | Solvent Optional Nonionic/ Suspension Aid | Liquid |
| Sodium Lauryl Sulfate | 20 | 99.8 | Anionic Surfactant | 0.2–150μ Particles |
| Sodium Citrate Dihydrate | 4 | 20 | Detergent Builder | 0.2–300μ Particles |
| Diethylenetriamine-pentaacetic Acid (DTPA) | 1.6 | 8 | Chelant | 5–300μ Particles |
| Tinopal AMS-BX*** | 0.3 | 1.6 | FWA | 5–200μ Particles |
| Sodium Carbonate | 12 | 59.9 | Alkalinity Source | 0.2–150μ Particles |
| Sodium Nonyloxybenzene-sulfonate | 5.3 | 26.4 | Bleach Activator | 0.2–150μ Particles |
| Sodium Perborate Monohydrate | 3 | 14.8 | Hydrogen Peroxide Source | 50–350μ Particles |
| Protease prills (Blue) | 0.4 | 2 | Enzyme | 300–800μ Prills |
| Total | 100 | 500 | | |

*C11 ethoxylated alcohol with 5 moles of ethylene oxide per mole of alcohol, from Shell Chemical Company.
**Polyoxypropylene-polyoxyethylene Block Copolymer from BASF Corporation.
***Fluorescent Whitening Agent from Ciba-Geigy Corporation.

The order in which the components are mixed plays no significant role in the achievement of the overall phase stability of the product. However, it is particularly convenient to proceed as follows in order to provide products of especially desirable bleach stability:

Into a 1-liter vessel are charged all the liquid ingredients (alcohol ethoxylates, organic solvent, Pluronic). The mixture is thoroughly mixed with a mechanical mixer (Lightnin mixer) operated at 350 rpm. With agitation continuing, the sodium citrate DTPA and FWA particles are added next. The resulting mixture is then further processed by subjecting it to high shear dispersing in a Ultra-Turrax T50, IKA-Labortechnik disperser operated at 3,000 $min^{-1}$.

The mixture is then returned to the Lightnin mixer and, with agitation at 500 rpm, the sodium lauryl sulfate is added. With continuous agitation, the sodium carbonate is added next, followed by the powdered bleach activator. The mixture is thoroughly mixed until all solid particles are wetted and nicely dispersed in the liquid matrix. The sodium perborate monohydrate is then added. Finally, the protease prills are then added last with mixing continuing at 800 rpm.

The finished product is an opaque, white, creamy liquid with suspended solids. The blue enzyme prills are visible and give the product a speckled appearance. The viscosity is 620 cps when measured on a Brookfield RV viscometer with a RV #5 spindle at 50 rpm. After I week at ambient temperature, the viscosity of the product reaches 1000 cps and remains relatively constant afterwards. Approximately 5% separation (clear phase on top layer) is observed after 3 days at ambient temperature. The separated phases are dispersed readily, and the dispensing properties of the product are good. Chemical stability of this product is excellent. After 4 weeks at 100° F., >85% of the original Available Oxygen is still retained.

Examples II–X

The compositions of this invention, as well as two comparative compositions, are illustrated by the examples set forth in Table II. All amounts listed are as weight percent of composition.

TABLE II

| Example No. | II | III | IV | V | VI | VII | VIII | IX | X |
|---|---|---|---|---|---|---|---|---|---|
| LIQUIDS | | | | | | | | | |
| Neodol 1-5 | — | 9.6 | — | 8.3 | 10 | 10 | 8.8 | 10 | — |
| Neodol 91-10 | — | | 18.4 | — | — | — | — | — | — |
| Neodol 23-9 | 17 | — | — | — | — | — | — | — | — |
| AlkoSurf 718 | — | — | — | 25 | 51 | 51 | — | 51 | — |
| DPNB Glycol Ether | 28.6 | 26.6 | 23.4 | | | | 26.6 | | 35 |
| Pluronic 10R5 | 9.3 | 9.6 | 8.8 | 10 | — | — | 10.6 | — | 14 |
| ATC | — | 9.6 | 3.7 | 14 | — | — | 10.6 | — | 14 |
| SOLIDS | | | | | | | | | |
| Sodium$C_{12}$LAS, 0.2–150μ | — | — | — | — | — | — | — | 16.7 | — |
| Sodium$C_{14}$SAS, 0.2–150μ | — | — | — | — | — | 16.7 | — | — | — |
| Sodium laurylsulfate, 0.2–150μ | 19.4 | 18.5 | 18.4 | 20.75 | 16.7 | — | 22 | — | — |
| Sodium PC, 50–350μ | | 3.5 | | | | | | | |
| Sodium PB1 | 2.9 | | 2.9 | 3.1 | 3.5 | 3.5 | 3.4 | 3.5 | 4.6 |
| DPA 5–300μ | — | 0.2 | 0.2 | 0.2 | 0.2 | 0.2 | 0.2 | 0.2 | 0.3 |

TABLE II-continued

| Example No. | II | III | IV | V | VI | VII | VIII | IX | X |
|---|---|---|---|---|---|---|---|---|---|
| DTPA 5–300μ | 1.6 | — | — | — | — | — | — | — | — |
| Sodium Carbonate, 0.2–150μ | 11.6 | 11.1 | 11.1 | 8.3 | 13.3 | 13.3 | 8.8 | 13.3 | 11.7 |
| Sodium Citrate, 0.2–300μ | 3.9 | 5.6 | 7.4 | 4.2 | — | — | 8.8 | — | 11.7 |
| Protease Prills, 200–800μ | 0.4 | 0.4 | 0.4 | 0.4 | 0.4 | 0.4 | — | 0.4 | 0.4 |
| FWA, 5–200μ | 0.3 | 0.3 | 0.2 | 0.2 | 0.2 | 0.2 | 0.2 | 0.2 | 0.3 |

Sodium C14SAS = Sodium C14 secondary alkyl sulfate from Shell Chemical Company
Sodium C12LAS = Sodium C12 linear alkylbenzene sulfonate
NaNOBS = Sodium Nonanoyloxybenzensulfonate
Sodium PC = Sodium percarbonate
Sodium PB1 = Sodium Perborate Monohydrate
DPNB Glycol Ether = Dipropylene glyco monobutyl ether from Dow Chemical Company
ATC = Acetyltriethylcitrate
Pluronic 10R5 = Polyoxypropylene-polyoxyethylene Block Copolymer from BASF Corporation
AlkoSurf 718 = Blended low molecular weight methyl esters from AlkoAmerica Corporation
Neodols = ethoxylated alcohols from Shell Chemical Company
FWA = Fluorescent Whitening Agent
DPA = Dipicolinic Acid
DTPA = Diethylenetriaminepentaacetic Acid Example IX is outside the scope of the present invention by virtue of its use of the linear alkylbenzene sulfonate anionic surfactant instead of the requisite alkyl sulfate anionic surfactant.

Example X is outside the scope of the present invention by virtue of its failure to include the requisite alcohol ethoxylate nonionic surfactant and alkyl sulfate anionic surfactant.

The observed phase properties for each of the Table II compositions are set forth in Table III.

TABLE III

| Example No. | II | III | IV | V | VI | VII | IX | X |
|---|---|---|---|---|---|---|---|---|
| Phase Property | S | S | S | S | S | S | $S^{++}$ | 70% T |
| Phase Property, 4 wk @ RT | Sl. Sep | Sl. Sep | Sl. Sep | Sl. Sep | Sl. Sep | Sl. Sep | $S^{++}$ | 70% T |

S = Single Phase, Pourable
Sl. Sep - Slightly Separated
$S^{++}$ = Not liquid
% T = % of composition which is clear liquid as Top layer From the Table III Phase Property summaries, it can be seen that Examples IX and X, which are outside the scope of the present invention, exhibit unacceptable or less suitable phase separation tendency than do the Examples II–VIII compositions of this invention.

What is claimed is:

1. A nonaqueous liquid heavy duty detergent composition in the form of a suspension of solid, substantially insoluble particulate material comprising a peroxygen bleaching agent and an anionic surfactant component, dispersed in a liquid phase comprising a nonionic surfactant component and a nonaqueous, low-polarity organic solvent component, wherein said composition is further characterized in that it comprises:

(a) from about 1% to 60% by weight of the composition of said nonionic surfactant component which comprises alcohol ethoxylates of the formula $R^1(OC_2H_4)_nOH$ wherein $R^1$ is a $C_6$–$C_{16}$ alkyl group and n is from about 1 to 80;

(b) from about 10% to 40% by weight of the composition of said anionic surfactant component which comprises sulfated $C_8$–$C_{20}$ alcohols and which is free of alkyl benzene sulfonate anionic surfactant materials;

(c) from about 2% to 30% by weight of the composition of particles of said peroxygen bleaching agent, which particles range in size from about 0.2 to 1,000 microns;

(d) from about 16% to 60% by weight of the composition of said nonaqueous, low-polarity organic solvent component, wherein said solvent component is selected from the group consisting of low molecular weight methyl esters of the formula $R^1$-C(O)—$OCH_3$, wherein $R^1$ ranges from 1 to 18 carbon atoms.

2. A composition according to claim 1 wherein (a) said nonionic surfactant component comprises materials selected from alcohol ethoxylates containing from about 9 to 15 carbon atoms and having from about 2 to 12 ethylene oxide moieties per molecule;

(b) said nonaqueous low-polarity organic solvent is selected from the group consisting of methyl acetate, methyl propionate, methyl octanoate and methyl dodecanoate;

(c) said peroxygen bleaching agent is selected from percarboxylic acids and salts thereof and alkali metal perborates and percarbonates; and (d) said anionic surfactant component comprises materials selected from $C_{10}$–$C_{14}$ primary alkyl sulfates.

3. A composition according to claim 2 wherein (a) said nonionic surfactant component comprises from about 5% to 35% by weight of the composition (b) said nonaqueous, low-polarity organic solvent comprises from about 16% to 45% by weight of the composition;

(c) said peroxygen bleaching agent particles comprises from about 2% to 20% by weight of the composition and range in particle size from about 1 to 800 microns; and (d) said anionic surfactant component comprises from about 15% to 30% by weight of the composition.

4. A composition according to claim 3 wherein (a) said peroxygen bleaching agent is selected from alkali metal perborates and percarbonates; and (b) said composition further comprises from about 2% to 10% by weight of the composition of particles of a bleach activator which can react with said peroxygen bleaching agent to form a peroxy acid, said bleach activator particles ranging in size from about 0.2 to 1,000 microns.

5. A composition according to claim 4 which also contains from about 1% to 20% by weight of the composition of an additional nonionic surfactant comprising ethylene oxide-propylene oxide block polymers.

6. A composition according to claim 4 which additionally contains from about 1% to 60% by weight of the composition of an organic detergent builder selected from alkali metal, citrates, succinates, malonates, carboxymethylsuccinates, carboxylates, polycarboxylates and polyacetylcarboxylates.

7. A composition according to claim 6 wherein said organic detergent builder is sodium citrate.

8. A composition according to claim 4 which additionally contains from about 5% to 30% by weight of an alkalinity source selected from water-soluble alkali metal carbonates, bicarbonates, borates, silicates and metasilicates.

9. A composition according to claim 8 wherein said alkalinity source is sodium carbonate.

10. A composition according to claim 6 which additionally contains from about 0.1% to 4% by weight of the composition of a chelating agent selected from amino carboxylates, amino phosphonates, polyfunctional substituted aromatic chelating agents and combinations of these chelating agents.

11. A composition according to claim 10 wherein said chelating agent is selected from diethylene triamine pentaacetic acid, ethylene diamine disuccinic acid and dipicolinic acid and the salts of these chelating agents.

12. A composition according to claim 6 which additionally contains from about 0.001% to 5% by weight of the composition of enzyme prills wherein said prills range in size from about 100 to 1,000 microns, and wherein said enzyme is selected from proteases, amylases, cellulases, and lipases.

13. A composition according to claim 6 which additionally contains (a) from about 0.1% to 4% by weight of the composition of a thickening, viscosity control and/or dispersing agent selected from acrylic acid-based polymers having a molecular weight ranging from about 2,000 to 10,000; and/or (b) from about 0.1% to 2% by weight of a compatible brightener, suds suppressor and/or perfume.

14. A nonaqueous, bleach-containing liquid heavy-duty detergent composition which comprises:

(a) from about 8% to 25% by weight of the composition of an ethoxylated alcohol liquid nonionic surfactant which contains from 10 to 14 carbon atoms and from about 3 to 10 moles of ethylene oxide;

(b) from about 20% to 45% by weight of the composition of a nonaqueous organic liquid solvent selected from low-molecular weight methyl esters of the formula $R_1$-C(O)—$OCH_3$ wherein $R_1$ ranges from 1 to about 18 carbon atoms.

(c) from about 16% to 30% by weight of the composition of particles of a $C_{10}$–$C_{14}$ alkyl sulfate anionic surfactant;

(d) from about 3% to 15% by weight of the composition of particles of a peroxygen bleaching agent selected from sodium and potassium perborates and percarbonates;

(e) from about 2% to 10% by weight of the composition of particles of a bleach activator selected from nonanoyloxybenzene sulfonate and tetraacetyl ethylene diamine;

(f) from about 5% to 20% by weight of the composition of particles of alkali metal carbonate; and (g) from about 0.01% to 1% by weight of the composition of enzyme prills comprising an enzyme selected from proteases, amylases, cellulases and lipases;

wherein said composition is free of alkyl benzene sulfonate anionic surfactants and wherein said composition is in the form of a suspension of particulate material comprising said particles and said prills, dispersed throughout said liquid nonionic surfactant and solvent components with said particulate material ranging in size from about 1 to 800 microns.

15. A composition according to claim 14 which also contains from about 5% to 10% by weight of the composition of an additional nonionic surfactant comprising ethylene oxide-propylene oxide bleach polymers.

16. A composition according to claim 14 which additionally contains from about 3% to 20% by weight of the composition of an organic detergent builder selected from alkali metal citrates.

17. A composition according to claim 16 which additionally contains from about 0.2% to 2% by weight of the composition of a chelating agent selected from diethylene triamine pentaacetic acid, ethylene diamine disuccinic acid and dipicolinic acid and the salts of these chelating agents.

18. A composition according to claim 17 which additionally contains from about 0.5% to 2% by weight of the composition of a thickening, viscosity control and/or dispersing agent selected from acrylic acid-based polymers having molecular weight of from about 2,000 to 10,000.

19. A composition according to claim 14 which has from about 30% to 70% by weight of the composition of a liquid phase and from about 30% to 70% by weight of the composition of a solid particulate phase.

20. A composition according to claim 19 which has a viscosity of from about 500 to 3,000 cps.

* * * * *